US008499364B2

(12) United States Patent
Dye

(10) Patent No.: US 8,499,364 B2
(45) Date of Patent: Aug. 6, 2013

(54) VISUAL PRIVACY GARMENT

(75) Inventor: Shannon M. Dye, Thornton, CO (US)

(73) Assignee: Camelflage LLC, Thornton, CO (US)

( * ) Notice: Subject to any disclaimer, the term of this patent is extended or adjusted under 35 U.S.C. 154(b) by 362 days.

(21) Appl. No.: 12/352,308

(22) Filed: Jan. 12, 2009

(65) Prior Publication Data

US 2010/0175170 A1 Jul. 15, 2010

(51) Int. Cl.
*A41B 9/04* (2006.01)

(52) U.S. Cl.
USPC ..... 2/406; 2/400; 2/401; 2/402; 2/407; 2/408; 2/67

(58) Field of Classification Search
USPC ..... 2/406, 407, 408, 67
See application file for complete search history.

(56) References Cited

U.S. PATENT DOCUMENTS

| | | | | |
|---|---|---|---|---|
| 2,401,457 | A | 4/1943 | Bryant | |
| 2,651,048 | A | 11/1952 | Milberg | |
| 4,121,305 | A | 10/1978 | Kolker | |
| 4,229,835 | A | 10/1980 | Shaw | |
| 4,557,267 | A | 12/1985 | Cole | |
| 5,023,957 | A | 6/1991 | Harvey | |
| 5,081,716 | A | 1/1992 | Lehenbauer et al. | |
| 5,285,531 | A | 2/1994 | Nalbandian | |
| 5,388,275 | A * | 2/1995 | Oram | 2/406 |
| 6,490,732 | B1 * | 12/2002 | Spoke | 2/67 |
| 6,560,786 | B2 | 5/2003 | Lipton | |
| 2004/0154079 | A1 | 8/2004 | Rana et al. | |
| 2008/0184461 | A1 | 8/2008 | Utaka | |

FOREIGN PATENT DOCUMENTS

WO 2004/112517 12/2004

* cited by examiner

*Primary Examiner* — Alissa Tompkins

(74) *Attorney, Agent, or Firm* — Michael Best & Friedrich LLP

(57) ABSTRACT

A ladies' visual privacy garment presents a smooth appearance over the vaginal area. The garment comprises a panty having a crotch portion provided with a layer of thin, flexible semi-rigid material that presents a smooth outer surface and overlies the vaginal area of the wearer, and a second layer of absorbent material.

5 Claims, 1 Drawing Sheet

VISUAL PRIVACY GARMENT

FIELD OF THE INVENTION

This invention relates to a ladies garment and, more particularly, to a panty having a crotch construction that provides visual privacy.

BACKGROUND OF THE INVENTION

In the design of panties worn under clothing for women, effort is made to provide a smooth appearance when, in the normal course of wear, the outer pants creep up and tighten about the crotch area. A problem is presented, however, in the design of tight fitting clothing which may be worn in various environments such as a workout at a gymnasium or evening wear that compliments and emphasizes the female figure. Garments that are too tight or which creep up may present a cameltoe appearance, particularly if the garment has a central seam that tightly overlies the labia majora. Although a fashionable appearance is desired, the cameltoe effect is not desired as part of a high fashion appearance.

SUMMARY OF THE INVENTION

In an embodiment of the present invention, the aforementioned problem of visual privacy is addressed by providing a panty having leg openings and a crotch portion between the openings extending upwardly at the front of the panty to provide a panel of material which, when the panty is worn, overlies the vaginal area of the wearer. The panty is constructed with a first inner layer at the area of concern of thin, flexible semi-rigid material that presents a smooth outer surface, and a second layer of absorbent material overlying the inner surface of the first layer and secured to the crotch portion of the garment, thereby providing the wearer with a comfortable garment that presents a smooth appearance over the vaginal area.

In another aspect of the invention, the first layer, though flexible, has minimal memory and thus assures that a smooth appearance is maintained.

Another aspect of the present invention is to provide the first layer with perforations therein to allow air flow and reduce moisture to thereby maintain the normal shape and fit of the garment.

Yet another aspect of the present invention is to provide a first layer that is composed of a thin neoprene material having a pattern of small holes therethrough that present perforations to allow air flow and reduce moisture in the crotch area. The second layer may comprise a microfilic fiber material overlying the inner surface of the first layer to absorb moisture and provide the wearer with a comfortable garment that presents a smooth surface over the vaginal area.

Other advantages and aspects of this invention will become apparent from the following description taken in connection with the accompanying drawings, wherein is set forth by way of illustration and example, an embodiment of the present invention.

DETAILED DESCRIPTION

Figure 1:
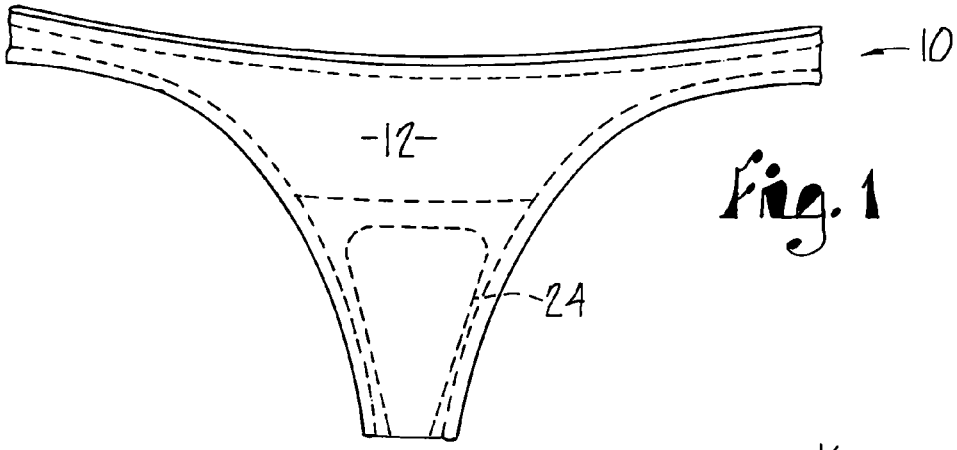
FIG. 1 is a front view of a thong undergarment embodying the improvements of the present invention.
Figure 2:
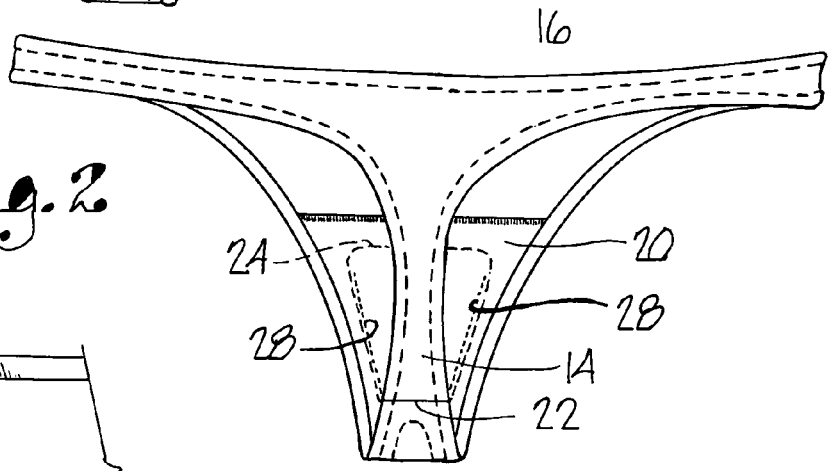
FIG. 2 is a rear view of the thong of FIG. 1.
Figure 4:
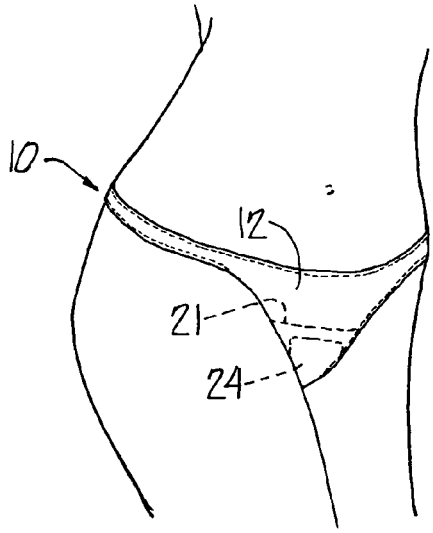
FIG. 4 is a view illustrating the garment as worn and showing certain hidden features in broken lines.

Referring initially to FIGS. 1, 2 and 4, a ladies' low-rise thong 10 is illustrated as exemplary of the visual privacy garment of the present invention, but is illustrative only as the teachings of the present invention apply to a full-back panty and other undergarments and tight-fitting clothing that may result in an undesirable cameltoe appearance. In the illustrated embodiment, the thong 10 comprises a generally triangularly shaped front panel 12 which tapers to a rear strap 14 extending from the crotch of the garment area to a waistband 16 at the rear of the garment, thereby defining a typical thong configuration as illustrated on the wearer in FIG. 4. At the bottom of the thong when worn, it overlies the labia majora and, absent the teachings of the present invention, can result in an undesired cameltoe appearance.

Figure 3:
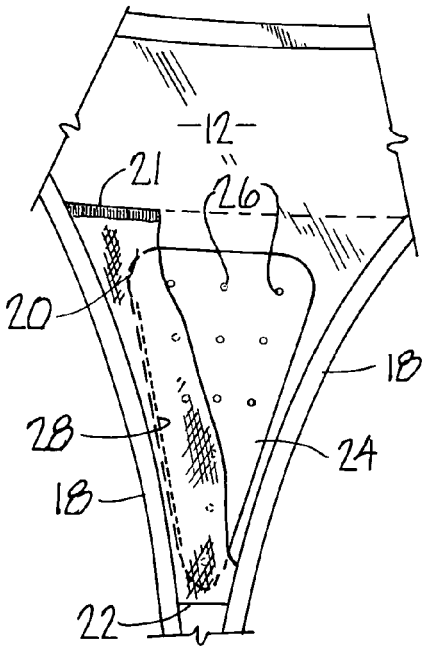
FIG. 3 is an enlarged, fragmentary, flat interior view of a frontal portion of the garment showing the construction thereof.

Particularly in the enlarged, fragmentary, interior view of FIG. 3 where the material is laid flat, it may be seen that the leg openings are defined by a hem 18 on each side of the panel 12, thereby defining a triangular, lower frontal portion of the panel 12 having a triangularly shaped inner layer 20 of absorbent material attached thereto at the hems 18 and by a line of stitching 21 that defines a horizontal, finished edge secured to the front panel 12. The layer 20, therefore, presents a lining extending over the crotch from stitching 21 to a narrow end 22 that, when the thong 10 is worn, is located above the base of the buttocks, as may be appreciated from the rear view of the thong shown in FIG. 2. The crotch lining is preferably secured to the thong 10 by the spaced hems 18.

A layer of thin, flexible, semi-rigid material 24 having a smooth outer surface is sandwiched/enclosed in a space between the panel 12 and the absorbent layer 20 and is provided with a plurality of perforations 26 which, in the illustrated embodiment, comprise three rows of three perforations 26 and three additional spaced perforations therebelow spaced to accommodate the triangular configuration of the panel 24. A line of stitching 28 along each lateral edge of the layer 24 essentially follows the lines of the hem 18 and secures the layer 24 in place. Preferably, layer 24 is comprised of a thin neoprene material having a thickness of approximately 1/32-1/16 inch so as to provide a flexible, semi-rigid panel having minimal memory and which will thus conform only to the general shape of the underlying body of the wearer. Accordingly, the cameltoe is covered as the neoprene material smooths out any lumps and bumps of the underlying anatomy to provide a smooth appearance even though the thong 20 may creep up in use, as is common if the wearer is active.

The inner layer 20 is preferably composed of a fiber having a high absorption and quick-drying qualities to maintain the user dry and comfortable. The inner layer 20 may also be provided with an antimicrobial finish that inhibits the growth of odor causing bacteria so that odors are not retained after washing.

In use, the first layer of protection to the wearer is the layer 24 which is preferably neoprene with a thickness of 1/32 to 1/16 inch, perforated with a number of holes 26 as illustrated and described above. Neoprene is preferred since it has minimal memory and thus will not conform to the underlying ridges and cavity that may be presented by a cameltoe. Other materials having similar characteristics may, of course, be used, and the thickness would be dependent upon the particular material utilized. A second layer of protection is provided by the inner layer 20 that provides comfort and reduces odor as set forth above.

Although the present invention is illustrated on a thong-type garment, it should be understood that it is equally applicable to shorts and other types and styles of garments having a low rise or which are otherwise styled such that a cameltoe appearance may result when the garment is worn.

Accordingly, it should be understood that while certain forms of the invention have been illustrated and described, it is not limited thereto except insofar as such limitations are included in the following claims.

Having thus described the invention, what is claimed as new and desired to be secured by Letters Patent is as follows:

1. A lady's visual privacy garment comprising:

a panty having leg openings and a crotch portion between said openings extending upwardly at a front of the panty to provide a front panel of material of generally triangular configuration complemental to the female anatomy and which extends downwardly from along a portion of a frontal waistline to a reduced width at the crotch portion to thereby overlie a vaginal area of a wearer, a first inner layer of thin, flexible semi-rigid material adjacent an inner face of a lower frontal portion of said front panel, the first inner layer having a first end configured to be positioned below a wearer's buttocks, the first inner layer extending forwardly from the first end over the crotch portion, and the first inner layer having minimal memory and presenting smooth inner and outer surfaces, said first inner layer having a pattern of small holes therethrough presenting perforations to allow air flow and reduce moisture, and a second layer of absorbent material overlying said inwardly facing surface of the first inner layer, and secured to said panty at hems of the leg openings on each side of the front panel and by first and second spaced-apart horizontal lines of stitching, the second layer thereby presenting a lining extending over the first inner layer and providing a space between the second layer and the front panel, wherein the first inner layer is secured in the space between the second layer and the front panel, wherein said first and second layers are of inverted, generally triangular configuration, whereby to provide the wearer with a comfortable garment that presents a smooth appearance over the vaginal area.

2. The invention as claimed in claim 1, wherein said first inner layer is a thin neoprene material.

3. The invention as claimed in claim 2, wherein said neoprene material has a thickness of approximately 1/32-1/16 inch.

4. The invention as claimed in claim 1, wherein said first layer has a thickness of approximately 1/32-1/16 inch to thereby provide said minimal memory, whereby to conform only to the general shape of the underlying body of the wearer.

5. A lady's visual privacy garment comprising:

a panty having a waistband, a pair of leg openings and a frontal portion between said openings presenting a triangularly shaped front panel having a maximum width at said waistline and extending and tapering downwardly to a minimum width at a crotch portion of a wearer, and a central rear portion continuous with said front panel and adapted to extend from the crotch upwardly to merge with said waistband at a central, rear portion thereof, an inner layer of absorbent material secured to the front panel at an interior portion thereof to form an enclosure with the front panel, said inner layer adapted to overlie a vaginal area of the wearer when the garment is worn, and an interior panel disposed in the enclosure, the interior panel having a first end configured to be positioned below a wearer's buttocks and the interior panel extending forwardly from the first end over the crotch portion, said interior panel having minimal memory and a plurality of spaced perforations therein to allow air flow and reduce moisture, whereby to present a smooth surface over the vaginal area of the wearer to prevent an undesired camel toe appearance when the garment is worn, wherein said inner layer and said interior panel are each generally triangular-shaped with decreasing width from top to bottom.

* * * * *